US009928706B2

(12) United States Patent
Gerdes

(10) Patent No.: US 9,928,706 B2
(45) Date of Patent: Mar. 27, 2018

(54) PRESENCE SIMULATION BASED ON A HOME ENTERTAINMENT SYSTEM

(71) Applicant: Harman Becker Automotive Systems GmbH, Karlsbad (DE)

(72) Inventor: Thomas Gerdes, Ulm (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 162 days.

(21) Appl. No.: 14/962,870

(22) Filed: Dec. 8, 2015

(65) Prior Publication Data

US 2016/0163169 A1 Jun. 9, 2016

(30) Foreign Application Priority Data

Dec. 8, 2014 (EP) ..... 14196771

(51) Int. Cl.

| | |
|---|---|
| ***G08B 13/00*** | (2006.01) |
| ***G08B 13/16*** | (2006.01) |
| ***H04R 29/00*** | (2006.01) |
| ***G08B 3/10*** | (2006.01) |
| ***G08B 15/00*** | (2006.01) |

(52) U.S. Cl.

CPC ..... *G08B 13/1672* (2013.01); *G08B 3/10* (2013.01); *G08B 15/002* (2013.01); *H04R 29/004* (2013.01); *H04R 2410/05* (2013.01)

(58) Field of Classification Search

CPC ..... H04B 1/00; H04L 1/00

See application file for complete search history.

(56) References Cited

U.S. PATENT DOCUMENTS 4,544,920 A * 10/1985 Hamlin ..... G08B 15/002 340/328
2009/0015375 A1* 1/2009 Yang ..... G08B 29/185 340/7.2

(Continued)

FOREIGN PATENT DOCUMENTS

DE 2922687 A1 12/1980
EP 2431956 A1 3/2012

(Continued)

OTHER PUBLICATIONS

Extended European Search Report for corresponding Application No. 14196771.1, dated May 22, 2015, 7 pages.

*Primary Examiner* — Shirley Lu
(74) *Attorney, Agent, or Firm* — Brooks Kushman P.C.

(57) ABSTRACT

A home entertainment system includes at least one media signal generating module, a microphone configured to pick up a noise signal of an environment in which the home entertainment system is located, a noise processing module configured to evaluate the noise signal picked up by the microphone, and a power control module configured to control the power provided to the at least one media signal generating module. When the noise processing module detects a predefined noise signal event in the noise signal, the power control module is configured to provide power to the at least one media signal generating module in response to the detected predefined noise signal event, and the at least one media signal generating module emits a presence media signal in response to the detected predefined noise signal event.

15 Claims, 4 Drawing Sheets

(56) References Cited

U.S. PATENT DOCUMENTS

| | | | | |
|---|---|---|---|---|
| 2012/0069246 | A1* | 3/2012 | Thornberry | G08B 15/002 348/730 |
| 2014/0240725 | A1* | 8/2014 | Banfield | G06F 19/3456 358/1.6 |

FOREIGN PATENT DOCUMENTS

| | | | |
|---|---|---|---|
| GB | 2146469 | A | 4/1985 |
| GB | 2202982 | A | 10/1988 |

* cited by examiner

PRESENCE SIMULATION BASED ON A HOME ENTERTAINMENT SYSTEM

CROSS-REFERENCE TO RELATED APPLICATIONS

This application claims priority to EP Application No. 14196771 filed Dec. 8, 2014, the disclosure of which is hereby incorporated in its entirety by reference herein.

TECHNICAL FIELD

Various embodiments relate to a system configured to emit a presence media signal to a method of operating the system and to a use of the home entertainment system as a system for emitting a presence media signal.

BACKGROUND

Security is a common concern today both for home owners as for business premises. From practice it is known to simulate a presence of a person to prevent burglaries. Darkened buildings during night-time hours are an attraction to potential thieves. It is known to control the lighting of a building in order to discourage intruders from seeking an unlawful entry as the light simulates occupancy. Furthermore, it is known to use more sophisticated systems detecting the presence of a person in a building, which then inform the public accordingly. However, these systems include sophisticated components and are expensive to install.

Accordingly, there is a need in the art for systems and methods which mitigate at least some of the shortcomings described above. There is in particular a need in the art for systems and methods which provide a presence simulation at low costs.

SUMMARY

According to exemplary embodiments, a system configured to emit a presence media signal is provided. The system includes at least one media signal generating module and a microphone configured to pick up a noise signal of an environment in which the system is located. The system further includes a noise processing module configured to evaluate the noise signal picked up by the microphone. The system furthermore includes a power control module configured to control the power provided to the at least one media signal generating module. When the noise processing unit detects a predefined noise signal event in the noise signal, the power control module is configured to provide power to the at least one media signal generating module in response to the detected predefined noise signal event and the at least one media signal generating module emits a presence media signal in response to the detected predefined noise signal event.

The system can be considered as a system configured to simulate a presence of a person to prevent burglars as the system can comprise a home entertainment system including a microphone and a noise processing module.

Home entertainment systems are widely spread and an existing home entertainment system can be used to simulate the presence of an inhabitant when the environment of the home entertainment system is monitored using a microphone connected to the home entertainment system. When a certain noise signal event such as a noise signal having a signal level over a predefined threshold or having a certain signal pattern is detected, the home entertainment system can be used to output a presence media signal in response to the detected noise signal event. The presence media signal can be a sound and/or video signal generated by one of the components of the home entertainment system, e.g. by a radio receiver, a television receiver or a media player provided in the home entertainment system. The media signal can be a multimedia signal including sound components in addition to video components, or can include one of the two components. If a television receiver is present in the home entertainment system or a media player able to playback a video signal, the presence media signal can include a video signal. Thus, it is possible to display images on a visual display and to output the corresponding audio sound in response to the detected noise signal event.

According to another aspect, a method for operating a system emitting a presence media signal is provided, the system includes the at least one media signal generating module, the microphone, the noise processing module and the power control module as mentioned above. The method includes the steps of picking up the noise signal of the environment in which the home entertainment system is located by the microphone. Furthermore, the noise signal picked up by the microphone is evaluated by the noise processing module. When a predefined noise signal event is detected in the noise signal, power is provided by the power control module to the at least one media signal generating module in response to the detected predefined noise signal event and a presence media signal is emitted by the media signal generating module in response to the detected predefined noise-signal event.

According to another aspect, the use of a home entertainment system as a system for emitting a presence media signal is provided in order to simulate a presence of a user in an environment in which the home entertainment system is located. The home entertainment system includes at least one media signal generating module, the power control module configured to control the power provided to the at least one media signal generating module and the timer configured to provide a starting time at which the at least one media signal generating module is provided with power. The timer is used to indicate a starting time at which the at least one media signal generating module is provided with power and the power control module is used to provide power to the at least one media signal generating module at the determined starting time. The media signal generating module is then used to output the presence media signal in response to the provided power. Here, the home entertainment system is used as a source which outputs a media signal at a desired time. Using the timer, a user can program the home entertainment system in such a way that at a predefined time, a media signal is emitted by the home entertainment system. In this embodiment, a microphone to pick up the sound in the neighborhood of the home entertainment system is not necessary. The user can use an existing home entertainment system to effectively simulate the presence of a person in a building. Thus, a housing, an apartment or company premises can be protected from burglars effectively and at low costs, as no additional hardware components need to be installed.

The features mentioned above and features yet to be explained may not only be used in isolation or in combination as explicitly indicated, but also in other combinations. Features and embodiments of the application may be combined unless explicitly mentioned otherwise.

BRIEF DESCRIPTION OF THE DRAWINGS

Various features of embodiments of the application will become more apparent when read in conjunction with the accompanying drawings.

DETAILED DESCRIPTION

Figure 1:
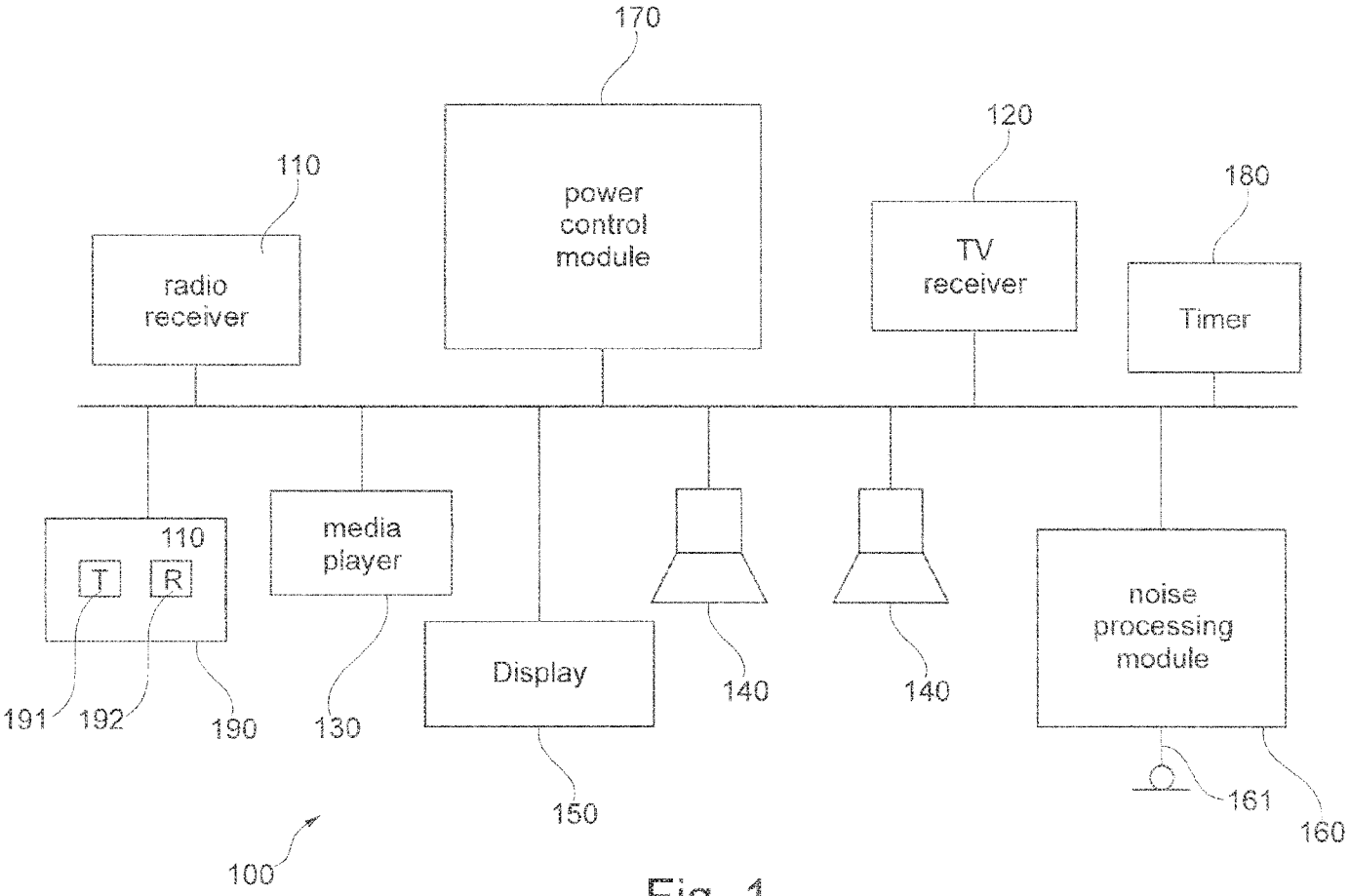
FIG. 1 is a schematic representation of a home entertainment system which can be used to simulate a presence of a user.

In the following, embodiments of the application will be described in detail with reference to the accompanying drawings. It is to be understood that the following description of embodiments is not to be taken in a limiting sense. The drawings are to be regarded as being schematic representations, and elements illustrated in the drawings are not necessarily shown to scale. Rather, the various elements are represented such that their function and general purpose becomes apparent for a person skilled in the art. Any connection or coupling between functional blocks, devices, components, or other physical or functional units shown in the drawings or described herein after may also be implemented by an indirect connection or coupling. A coupling between components may also be established over a wireless connection. Functional blocks may be implemented in hardware, firmware, software or a combination thereof.

Hereinafter, it is disclosed the manner in which a home entertainment system can be used to simulate the presence of an inhabitant. The presence simulation will be done by switching on or off the home entertainment system automatically. It is possible to determine and adjust the action carried out by the home entertainment system. In this context, it is possible to determine which sound and/or which video signal and which sound level or parameters of the video signals should be output. The home entertainment system can be either activated by a predefined noise signal event picked up by an internal or external connected microphone. Furthermore, it is possible that the home entertainment system is activated or deactivated through a programmable timer, wherein the time can be configured to generate a randomized time schedule at which the home entertainment system should be turned on or off.

FIG. 1 shows a schematic view of system 100 configured to emit a presence media signal. The system can be considered as a specially configured home entertainment system, and is thus simply called home entertainment system hereafter. The home entertainment system comprises media signal generating modules (110, 120, and 130) such as a radio receiver 110, a television receiver 120 or a media player 130. The radio receiver 110 is configured to receive analogue and/or digital radio signals and can process them in such a way that different radio programs contained in the radio signals can be output, for example, by a loudspeaker system 140. In the embodiment shown, two loudspeakers 140 are shown. However, it should be understood that any other number of loudspeakers may be used. By way of example, the home entertainment system may have a 5.1 surround system or any other number of loudspeakers, which are able to output an audio sound. The TV receiver 120 can be configured to receive analogue or digital television signals and can be configured to process the signals in such a way that different television programs can be output, the television program comprising audio and video components. The audio components can be output using the loudspeakers 140 mentioned above, wherein the video component can be output on display 150.

A media player 130 can be provided which is configured to playback media data, for example, a CD or DVD. Furthermore, the media player may have a storage unit (not shown) on which a plurality of media files can be stored which can comprise audio and/or video signal components. The storage unit and the media player can be a hard disk, a read-only memory, a flash memory, a random access memory, a NAS (Network Attached Storage), a Cloud memory, streaming services or any other mass storage.

Furthermore, a noise processing module is provided which evaluates a noise signal picked up by a microphone 161. The noise processing module 160 processes the received noise signal and determines whether an indication can be found in the signal that an unlawful entry into a room where the home entertainment system is located is detected. This detection can be based on a signal level meaning that if a first signal level higher than a predefined threshold is detected by the microphone 161, it is concluded that someone is present in the neighborhood of the home entertainment system. In addition, predefined signal pattern may be used by the noise processing module stored in a memory (not shown) of the noise processing module and the detected noise signal may be compared to the predefined signal patterns in order to determine whether a noise signal event has occurred from which might be deduced that the presence simulation by the home entertainment system is necessary.

The home entertainment system furthermore comprises a power control module 170 which is configured to control the power provided to the different modules such as the radio receiver, the media player 130, the TV receiver 120 or to the different other functional components shown in FIG. 1. By way of example, when the noise processing module 160 detects a noise signal event from which it is deduced that a media signal should be output by the home entertainment system, the power control module 170 can be informed accordingly and the power control module 170 can provide power to one or several of the media signal generating modules such as the radio receiver 110, the media player 130 or the TV receiver 120. The home entertainment system may work in an operating mode in which all of the media signal generating modules 110, 120 or 130 are turned off or working in a stand-by mode in which they have to be woken up before they can fully operate. Only the noise processing module 160 may operate in a full operating mode in which it can process the noise signal. In another embodiment, the home entertainment system may be operating in a stand-by mode in which the home entertainment system and also the power control module is operating in a stand-by mode and can respond to a wake-up or trigger event. If this wake-up or trigger event is detected by the noise processing module 160 in the form of a certain noise signal event, the power control module 170 can be informed accordingly and the latter can provide power to one of the media signal generating modules 110-130 and a media signal can be output by the loudspeakers 140. The wake-up signal can also wake up the noise processing module if the latter is working in a sleep or stand-by mode. If the radio receiver is used for emitting a sound signal, also called presence media signal, a radio program may be used for the audio signal output. The user may be able to determine via an input unit (not shown) which radio signals will be used for the output. When the TV receiver 120 is selected for the output of the presence media signal a certain television program may be preselected by a user and the current television program broadcast at the time when the presence signal should be output, is selected and output via the loudspeakers 140 and via display 150. If the media player 130 is the source for the presence signal, it can be possible to preselect a media file to be output by the home entertainment system when the output is triggered by the noise signal event. A timer 180 is provided. The timer 180 is a programmable timer which can be programmed by a user. By way of example, it can be possible to indicate over a longer period of time such as one week, several weeks or even several months, at which time the home entertainment system should output a presence signal. It is possible that a kind of timetable is provided in which the user of the home entertainment system can indicate precisely at which date and time of the day a presence media signal should be output. Furthermore, the timer 180 may indicate when the presence media signal should be stopped. In this context, the timer 180 can either indicate to the power control module when the power should be removed from the corresponding sound-generating module or the timer can directly indicate to the corresponding media signal generating module that the output of the presence media signal should be stopped. The user can either directly input a switch-on and a switch-off time for the different times of a day or week or month, or it is possible that only the switch-on time is indicated wherein power is removed from the corresponding media signal generating module after a predefined time period after the corresponding media signal generating module had been switched on.

Furthermore, an input/output unit 190 is provided with a transmitter 191 and a receiver 192. The input/output unit 190 can be used for communication with other entities or with a wide-area network such as the internet. By way of example, the user of the home entertainment system may use an application accessible via the internet e.g. via a mobile phone in order to control the home entertainment system. The application accessible via the internet may be designed in such a way that a user can configure the home entertainment system in such a way that it can be determined at which point in time the power control module 170 supplies power to one of the media signal generating modules 110-130. Furthermore, the home entertainment system could be controlled remotely in such a way that the user can determine which audio source is used for the presence media signal. By way of example, if the radio receiver is used, the user can specify which radio program should be used for the output of the presence media signal or which television program should be used or if the media player 130 is used which media file such as a CD or DVD or a media file stored on a storage unit of the media player is used for the generation of the presence media signal. The receiver 192 can be used to receive the packet switched signals from the internet, whereas the transmitter 191 may be used to either send confirmation information for the presence operating parameters or any feedback to the received control commands for the home entertainment system.

It should be understood that the input/output unit 190 is also adapted to be controlled by a user directly at the home entertainment system, be it via actuating elements (not shown) provided at the home entertainment system or via a remote control communicating with the input/output unit 190.

Figure 2:
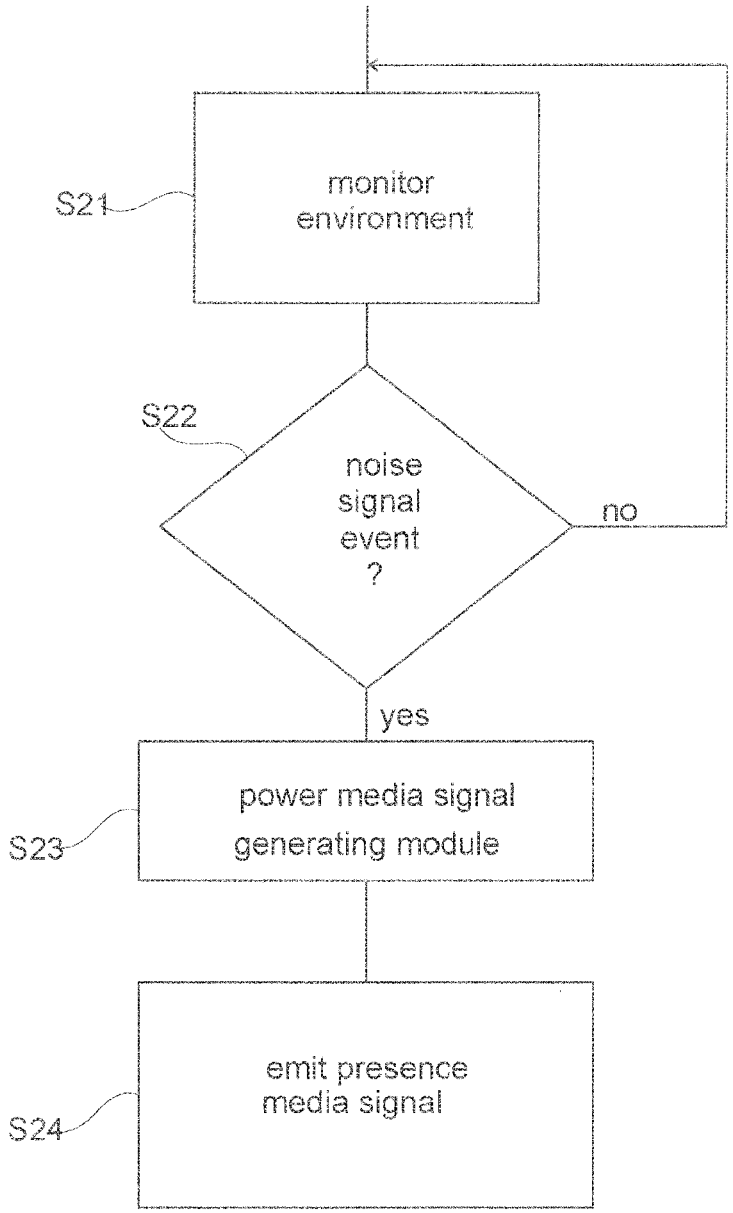
FIG. 2 is a flow chart for a method carried out by the home entertainment system in order to simulate presence.
Figure 4:
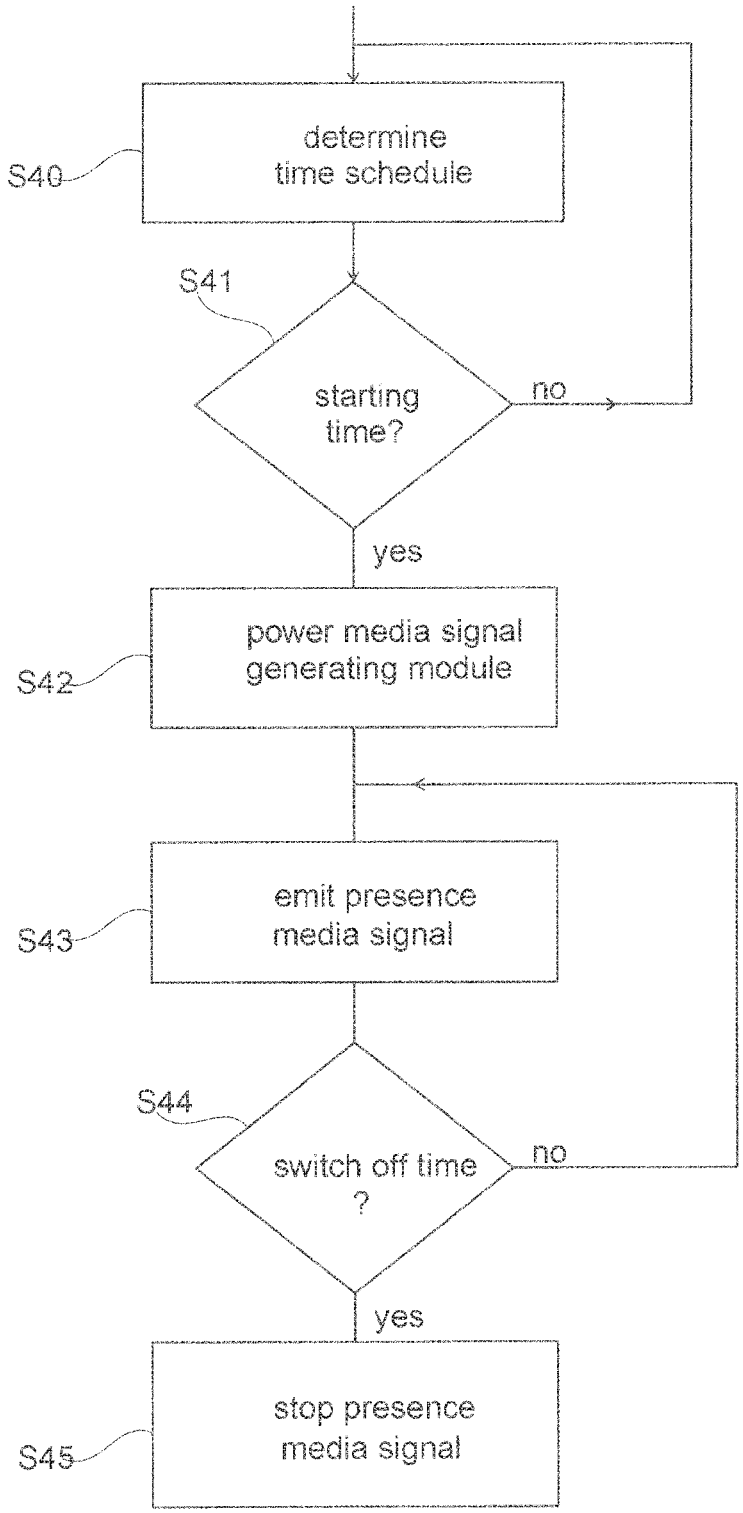
FIG. 4 is a flow chart showing the steps when the home entertainment system is used as a system which emits a presence media signal at predefined time periods.

In connection with FIGS. 2 and 4, different embodiments are described how the home entertainment system can be used.

FIG. 2 shows the major steps carried out for the generation of a presence media signal using the system of FIG. 1. In step S21, the environment in which the home entertainment system is located is monitored, e.g. using microphone 161 of FIG. 1. Using noise processing module 160, it is checked in step S22 whether a predefined noise signal event can be detected. This noise signal event can be a noise signal having a signal level that is higher than a predefined signal level or it can include the detection of predefined noise patterns such as the breaking of a window etc. Furthermore, the noise processing module may contain some prestored noise pattern, which should not lead to the generation of a presence media signal. These predefined patterns can include signal patterns generated by a police vehicle or ambulance with its siren going. Furthermore, the user may be able to record or register ambience noises which should not trigger the generation of a presence media signal. As the ambience noise can largely depend on the location at which the home entertainment system is located, it might be necessary to provide the noise processing module with different patterns which are considered as normal operating sounds in the environment of the home entertainment system. These noise patterns may be recorded using microphone 161 and stored in the noise processing module so that the generation of a presence media signal in response to the detection of these signal patterns is avoided.

If no predefined noise signal event as discussed above is detected, the system continues to monitor the environment. If, however, a predefined noise signal is detected in step S22, the media signal generating module can be provided with power in step S23. The different media signal generating modules, before step S23, may be operating in a sleep mode or stand-by mode or may be shut off completely, wherein only the noise-processing module may be operating in order to process and detect the predefined noise signal event. When one of the media signal generating modules such as the radio receiver 110, the television receiver 120 or the media player 130 is turned on, the latter can than generate, in step S24, the desired presence media signal.

Figure 3:
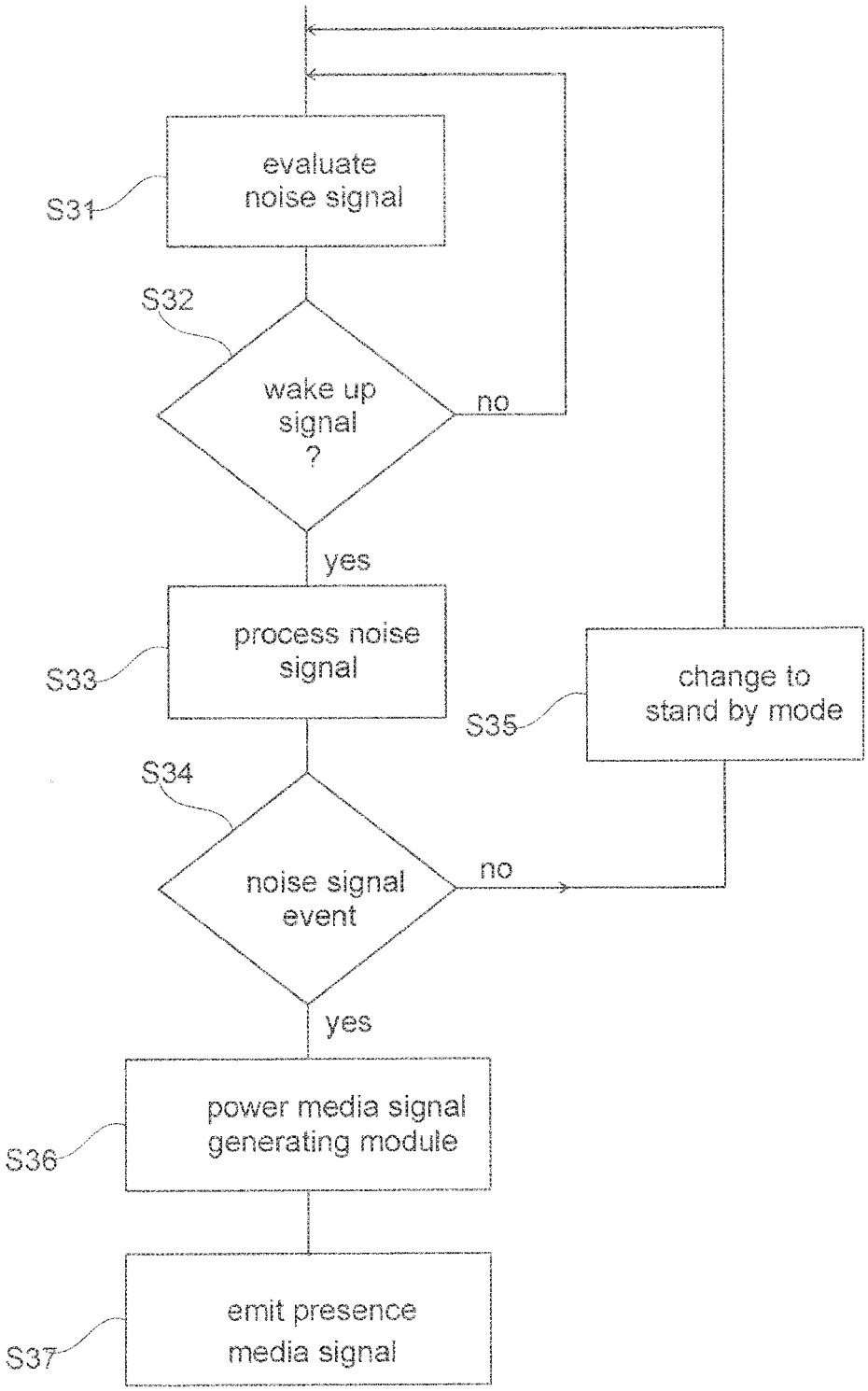
FIG. 3 is a flow chart of another method used to simulate the presence of a user.

In the embodiment described in connection with FIG. 2, the noise processing module 160 is in an operating state which directly allows the detected noise signal to be processed. As will be discussed below in connection with FIG. 3, it is also possible that the noise processing module 160 is operating in a stand-by mode which it cannot continuously process the detected noise signal. In the embodiment of FIG. 3, a kind of trigger signal is needed in order to wake the noise processing module 160 before the noise signal is analyzed in detail in order to see whether a predefined noise signal is detected or not. In the embodiment of FIG. 3, the noise processing module is operating in a stand-by or sleep mode. In step S31, the noise processing module is nevertheless configured in such a way that it can detect a wake-up signal so that in step S31, the noise signal is at least evaluated in such a way that a wake-up signal can be detected. The wake-up signal can be a noise signal which is higher than a predefined signal level or can be the detection of a certain signal evaluation over time. In step S32, it is checked in this stand-by or sleep mode whether the wake-up signal is present in the detected noise. If this is the case, the operating mode of the noise processing module 160 can be changed in such a way that the noise processing module 160 is enabled to process the noise signal. The operating status may change from a stand-by or sleep mode to a fully working operating mode (step S33). In step S34, it is then determined in detail whether a predefined noise signal event is actually present in the detected noise signal or not. If this is not the case, the noise processing module may change to the stand-by mode again in step S35 and return to step S31. If, however, the predefined noise signal event is detected as was already discussed in connection with FIG. 2 in step S36, the presence media signal is output in step S37.

In the embodiment shown in FIG. 1, the microphone 161 is shown as being directly connected to the noise processing module 160. Such an embodiment may be advantageous when all the functional elements of FIG. 1 except the noise processing module 160 are switched off completely. However, it should be understood that the microphone 161 needs not be directly coupled to the noise processing module 160. The microphone 161 may also be connected to the home entertainment system 100 using a separate functional entity which can pass the detected noise signals directly to one of the other modules without having to pass through the noise processing module 160.

In connection with FIG. 4, an embodiment is disclosed in which the home entertainment system is not necessarily used in connection with a microphone. In this embodiment, only the time provided by timer 180 triggers the generation of a presence media signal. By way of example, a user may have programmed the home entertainment system in such a way that at different points in time a certain presence media signal is output by home entertainment system 100 in accordance with a time schedule input to the system by a user. It is checked in step S40 at which time the emission of a presence media signal is desired. In step S41 it is then checked whether the starting time has been reached. If it is detected in step S41 that a starting time indicated by the timetable has been reached, the power control module can power the media signal generating module in step S42. After step S42, the selected media signal generating module can then emit the presence media signal in step S43 until the switch-off time is reached in step S44. As long as the switch-off time has not been reached, the presence media signal is output. Only when the event or the time period at which the output of the presence media signal should be stopped is reached, the presence media signal is stopped in step S45. The determination whether the output of the presence media signal should be stopped may include the step of determining whether the user has set a certain date or time when the output should be stopped. In another embodiment, the user may have simply determined the length of the output of the presence media signal, i.e., the length of the time period so that after this time period has lapsed, the emission of the presence media signal is stopped. In still another example, the home entertainment system includes a preset switch-off time so that each time after the presence media signal has been turned on; it is automatically switched off after a predefined time period.

From the above discussion, the following generalized conclusions can be drawn: the home entertainment system may comprise a programmable timer configured for an input of a starting time at which the at least one media signal generating module is provided with power, wherein the power control module is configured to provide power to the at least one media signal generating module at the time indicated by the timer and the media signal generating module is configured to emit the media signal at the time indicated by the timer.

The timer may be configured for an input of a switch-off time at which the media signal generating module should stop to emit the presence media signal, wherein the power control module can be configured to remove the power from the media signal generating module after the switch-off time. In another embodiment the timer is configured to indicate the predefined time period after which the power control module switches off the power at the media signal generating module, wherein the power control module is configured to remove the power from the media signal generating module at the switch-off time.

Furthermore, an interface may be provided to receive packet switched signals from a wide-area network such as the internet. The packet switched signals can contain control commands for the operation of the home entertainment system. The power control module can be configured to provide power to the media signal generating module and to remove power from the media signal generating module in accordance with the received control commands.

In one embodiment, the noise processing module may work in a fully activated operating mode in which the noise processing module can directly process and detect the predefined noise signal event, whereas the at least one media signal generating module is working in a stand-by mode or is shut off completely. In another embodiment, however, also the noise processing module is operating in a stand-by operating mode in which the sound processing module is not configured to evaluate the noise signal but is configured to detect a wake-up signal. When the noise processing module then detects the wake-up signal, the noise processing module is configured to change into an operating mode in which it evaluates the noise signal. In this context, the noise processing module can be configured to change from the stand-by mode into the operating mode if it detects a noise signal with a signal level above a predefined signal level threshold or a signal level having a predefined signal pattern.

When the media signal generating modules comprise a television receiver, the television receiver may be configured to output a predefined television program including audio and video signals as presence media signal.

Furthermore, the noise processing module can be configured to identify non-signal events which prevent the media signal generating module emitting the presence media signal when the non-signal event is detected by the noise processing module. In the corresponding method, it is possible to store these non-signal events and when one of these non-signal events is detected, the emission of the presence media signal is disabled. This can help to accustom the home entertainment system to the environment in which it is located. By way of example, if the triggering noise signal event is the detection of a signal that is higher than a predefined signal threshold, it can be checked whether the signal pattern corresponds to one of the stored non-signal events, and if this is the case, the emission of the presence media signal is omitted even when the signal is higher than the predefined signal threshold. Summarizing, it is possible to output a presence media signal with minimum additional costs for hardware as a home entertainment system including or not a microphone is present in many apartments or buildings. This home entertainment system can be used for the generation of a presence media signal which simulates the presence of a user at the location where the home entertainment system is located.

What is claimed is:

1. A system configured to emit a presence media signal, the system comprising:

at least one media signal generating module;

a microphone configured to pick up a noise signal of an environment in which the system is located;

a noise processing module configured to evaluate the noise signal picked up by the microphone; and a power control module configured to control the power provided to the at least one media signal generating module, wherein when the noise processing module detects a predefined noise signal event in the noise signal, and wherein the power control module is further configured to provide power to the at least one media signal generating module in response to the detected predefined noise signal event, and the at least one media signal generating module emits a presence media signal in response to the detected predefined noise signal event, wherein a plurality of non-signal events is stored in memory, wherein the noise processing module is configured to:

determine whether the noise signal includes a signal level that exceeds a predefined signal level, and determine whether a signal pattern of the noise signal corresponds to one of the stored non-signal events, and wherein the at least one media signal generating module refrains from emitting the presence media signal when the signal level of the noise signal exceeds the predefined signal level and when the signal pattern corresponds to the one of the stored non-signal events.

2. The system according to claim 1, including a programmable timer configured for an input of a starting time at which the at least one media signal generating module is provided with power, wherein the power control module is configured to provide power to the at least one media signal generating module at the time indicated by the programmable timer and the at least one media signal generating module is configured to emit the presence media signal at the time indicated by the programmable timer.

3. The system according to claim 2, wherein the programmable timer is configured for an input of a switch off time at which the at least one media signal generating module stops to emit the presence media signal and wherein the power control module is configured to remove the power from the at least one media signal generating module after the switch off time.

4. The system according to claim 2, wherein the programmable timer is further configured to indicate a predefined time period after which the power control module is further configured to switch off the power at the at least one media signal generating module, wherein the power control module is configured to remove the power from the at least one media signal generating module at the switch off time.

5. The system according to claim 1, including a receiver configured to receive packet switched signals from a Wide Area Network, the packet switched signals including control commands for operation of a home entertainment system, wherein the power control module is further configured to provide power to the at least one media signal generating module and to remove power from the at least one media signal generating module in accordance with the received control commands.

6. The system of claim 1, wherein the noise processing module is further configured to operate in a standby mode in which the noise processing module fails to evaluate the noise signal, wherein the noise processing module is further configured to detect a wake up signal, and wherein when the noise processing module detects the wake up signal, the noise processing module is further configured to change into an operating mode in which the noise processing module evaluates the noise signal in order to determine whether the predefined noise event is present in the noise signal.

7. The system according to claim 6, wherein the noise processing module is configured is configured to change from the standby mode into the operating mode in response to detecting that the noise signal with the signal level is above the predefined signal level or the signal level includes a predefined signal pattern.

8. The system according to claim 1, wherein the at least one media signal generating module includes at least one loudspeaker and at least one of a radio receiver, a television receiver, and a media player.

9. The system according to claim 1, wherein the at least one media signal generating module includes a television receiver configured to output a predefined television program including video and audio signals as the presence media signal.

10. The system according to claim 1, wherein the at least one media signal generating module includes a media player configured to output a predefined media file as the presence media signal.

11. A method for operating a system emitting a presence media signal, the system including at least one media signal generating module, a microphone, a noise processing module and a power control module, the method comprising the steps of:

picking up, by the microphone, a noise signal of an environment in which the system is located, evaluating, by the noise processing module, the noise signal picked up by the microphone, wherein when a predefined noise signal event is detected in the noise signal, power is provided by the power control module to the at least one media signal generating module in response to the detected predefined noise signal event, and a presence media signal is emitted by the at least one media signal generating module in response to the detected predefined noise signal event;

storing a plurality of non-signal events in memory, determining whether the noise signal includes a signal level that exceeds a predefined signal level;

determining whether a signal pattern corresponds to one of the stored non-signal events, and refraining from emitting the presence media signal when the signal level of the noise signal exceeds the predefined signal level and when the signal pattern corresponds to the one of the stored non-signal events.

12. The method according to claim 11, further comprising the steps of:

detecting an input of a starting time at which the at least one media signal generating module is provided with power, providing the power to the at least one media signal generating module at the time indicated by a programmable timer, and emitting the presence media signal at the time indicated by the programmable timer.

13. The method according to claim 12, further comprising the steps of:

detecting an input of a switch off time at which the at least one media signal generating module should stop to emit the presence media signal, and automatically removing the power from the at least one media signal generating module after the switch off time.

14. The method according to claim 11, wherein the noise processing module is operating in a standby mode such that the noise processing module fails to evaluate the noise signal, wherein the noise processing module is monitored as whether a wake up signal is detected, and wherein when the wake up signal is detected, changing the noise processing module into an operating mode in which the noise signal is evaluated in order to determine whether the predefined noise event is present in the noise signal.

15. A system configured to emit a presence media signal, the system comprising:

at least one media signal generating module;

a noise processing module configured to evaluate noise signal picked up by a microphone; and a power control module configured to control the power provided to the at least one media signal generating module, wherein when the noise processing module detects a predefined noise signal event in the noise signal, and wherein the power control module is further configured to provide power to the at least one media signal generating module in response to the detected predefined noise signal event, and the at least one media signal generating module emits a presence media signal in response to the detected predefined noise signal event, wherein a plurality of non-signal events is stored in memory, wherein the noise processing module is configured to:

determine whether the noise signal includes a signal level that exceeds a predefined signal threshold, and determine whether a signal pattern of the noise signal corresponds to one of the stored non-signal events, and wherein the at least one media signal generating module refrains from emitting the presence media signal when the signal level of the noise signal exceeds the predefined signal level and when the signal pattern corresponds to the one of the stored non-signal events.

* * * * *